US009658599B2

(12) United States Patent
Stranczl

(10) Patent No.: US 9,658,599 B2
(45) Date of Patent: May 23, 2017

(54) FLEXIBLE COLLET

(71) Applicant: Nivarox-FAR S.A., Le Locle (CH)

(72) Inventor: Marc Stranczl, Nyon (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/944,790

(22) Filed: Nov. 18, 2015

(65) Prior Publication Data

US 2016/0147197 A1 May 26, 2016

(30) Foreign Application Priority Data

Nov. 20, 2014 (EP) ..... 14194118

(51) Int. Cl.
*G04B 17/34* (2006.01)

(52) U.S. Cl.
CPC ..... *G04B 17/34* (2013.01); *G04B 17/345* (2013.01)

(58) Field of Classification Search
CPC ..... G04B 13/022; G04B 7/345; G04B 31/04; G04B 29/04; G04B 17/066; G04B 17/34; G04B 7/3451
USPC ..... 368/175–177
See application file for complete search history.

(56) References Cited

U.S. PATENT DOCUMENTS 3,430,435 A 3/1969 Dumont
8,206,029 B2 * 6/2012 Vaucher ..... G04B 13/022 29/893.2
8,882,341 B2 * 11/2014 Chu ..... G04B 17/345 368/177
9,146,537 B2 * 9/2015 Cattiau ..... G04B 37/0091
2005/0219957 A1 * 10/2005 Lambert ..... G04B 17/34 368/177
2009/0154303 A1 * 6/2009 Vaucher ..... G04B 13/022 368/322
2010/0110840 A1 5/2010 Zaugg et al.
2011/0199866 A1 8/2011 Zaugg et al.
2013/0047437 A1 * 2/2013 Daout ..... G04B 17/345 29/896.31
2014/0198627 A1 * 7/2014 Chu ..... G04B 17/345 368/177
2015/0023140 A1 * 1/2015 Daout ..... G04B 17/345 368/177

FOREIGN PATENT DOCUMENTS

CH 613 833 A3 10/1979
CH 700 032 B1 6/2010
(Continued)

OTHER PUBLICATIONS

European Search Report with Written Opinion issued Aug. 27, 2015 in European Application 14194118.7, filed on Nov. 20, 2014 with English translation.

*Primary Examiner* — Sean Kayes
(74) *Attorney, Agent, or Firm* — Oblon, McClelland, Maier & Neustadt, L.L.P.

(57) ABSTRACT

Timepiece collet comprising a point of attachment to a balance spring and a passage intended to receive a balance staff. According to the invention, the passage is substantially cylindrical and is configured to deform elastically in a plane perpendicular to the axis of the passage and to elastically clamp the balance staff by at least two lines of contact extending over the height of the inner wall of the passage when the balance staff is inserted in the passage.

20 Claims, 1 Drawing Sheet

(56) References Cited

FOREIGN PATENT DOCUMENTS

| | | | |
|---|---|---|---|
| EP | 1 513 029 | A1 | 3/2005 |
| EP | 1 584 994 | A1 | 10/2005 |
| EP | 2 003 523 | A1 | 12/2008 |
| EP | 2 184 652 | A1 | 5/2010 |
| WO | WO 2011/026725 | A1 | 3/2011 |

* cited by examiner

FLEXIBLE COLLET

FIELD OF THE INVENTION

The invention relates to a resilient collet intended to be fixed on an arbor. The invention also concerns a one-piece balance spring/resilient collet assembly, and a method for manufacturing such a one-piece assembly.

This application claims priority from European Patent Application No. 1419118.7 filed Nov. 20, 2014, the entire disclosure of which is hereby incorporated herein by reference.

BACKGROUND OF THE INVENTION

Generally, the balance spring is placed on the balance staff by means of a collet, which takes the form of a ring intended to be pressed onto the balance staff and pierced laterally to receive the inner end of the balance spring. The balance staff may also be welded or soldered on the collet. The development of micro-manufacturing techniques, such as DRIE methods for silicon, have made it possible to manufacture collets with new shapes and geometries. It is possible, in particular, to make the collet in one-piece with the balance spring.

Silicon is a material exhibiting numerous advantages for the manufacture of balance springs, and micro-manufacturing techniques make it possible to form a one-piece balance spring/collet assembly. The main drawback of silicon is that it has no plastic deformation. Collets can thus break easily if stresses exceed the elastic limit. The collet must therefore be dimensioned both to hold the balance spring on the balance staff during operation of the oscillator (minimum clamping torque), and to allow the collet to be assembled to arbors without breaking (or undergoing plastic deformation) if the diameter of the balance staff and the geometric variations of the collet remain within a given tolerance range.

EP Patent No 1513029 and EP Patent No 2003523 propose collets having a triangular opening. The balance spring is fixed at a point of attachment located at one of the apexes of the triangles. The collet is formed of an external stiffening structure to which there are attached flexible arms which deform to accommodate the balance staff.

There is also known from WO Patent No 2011026725 a balance spring-collet assembly, with a collet having a bore provided with four circular support portions for receiving the balance staff. The support portions are delimited by longitudinal grooves made in the collet bore.

The geometries described in these documents are not entirely satisfactory, so that many of balance springs (made of silicon, diamond, quartz . . . ) mounted on movements are provided with a collet adhesive bonded on the balance staff.

SUMMARY OF THE INVENTION

It is an object of the present invention to overcome all or part of the aforementioned drawbacks.

To this end, the invention relates to a timepiece collet comprising a point of attachment to a balance spring and a passage or opening intended to receive a balance staff.

According to the invention, the passage is substantially cylindrical and is configured to deform elastically in a plane perpendicular to the axis of the passage and to elastically clamp the balance staff by at least two lines of contact extending over the height of the inner wall of the passage when the balance staff is inserted in the passage.

It is thus understood that such a collet allows for optimum pressing-in force and holding torque, with the deformation force clamping the collet onto the staff above a nominal holding torque.

One advantage of the invention is that the entire collet is deformed, unlike prior art collets, the collet has no nose or other rigid portion. In the case of the invention, virtually the entire collet is deformed, except for the point of attachment of the collet.

In accordance with other advantageous variants of the invention:

- the passage is ovoid-shaped;
- the three lines of contact have angular openings $\alpha$, $\beta$, $\theta$, one of the lines of contact being diametrically opposite the point of attachment to the balance spring;
- the angular openings $\alpha$, $\beta$, $\theta$ are greater than 90°;
- the angular openings $\alpha$, $\beta$, $\theta$ are equal to 120';
- the distance between the balance staff and the collet at the recessed parts is comprised between 0 and one quarter of the diameter of the balance staff, and more preferably between 0 and 50 μm,
- the collet is of variable section.

The invention also concerns a one-piece collet/balance spring assembly comprising a collet according to the invention.

In accordance with other advantageous variants of the invention:

- the collet and the balance spring are made of silicon;
- the collet and the balance spring are made of a material having no plastic deformation.

The invention also concerns a timepiece movement or a timepiece comprising a collet/balance spring assembly according to the invention.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

As explained above, the invention relates to a collet made of a material with no usable plastic range, i.e. with a very limited plastic range.

Figure 2:
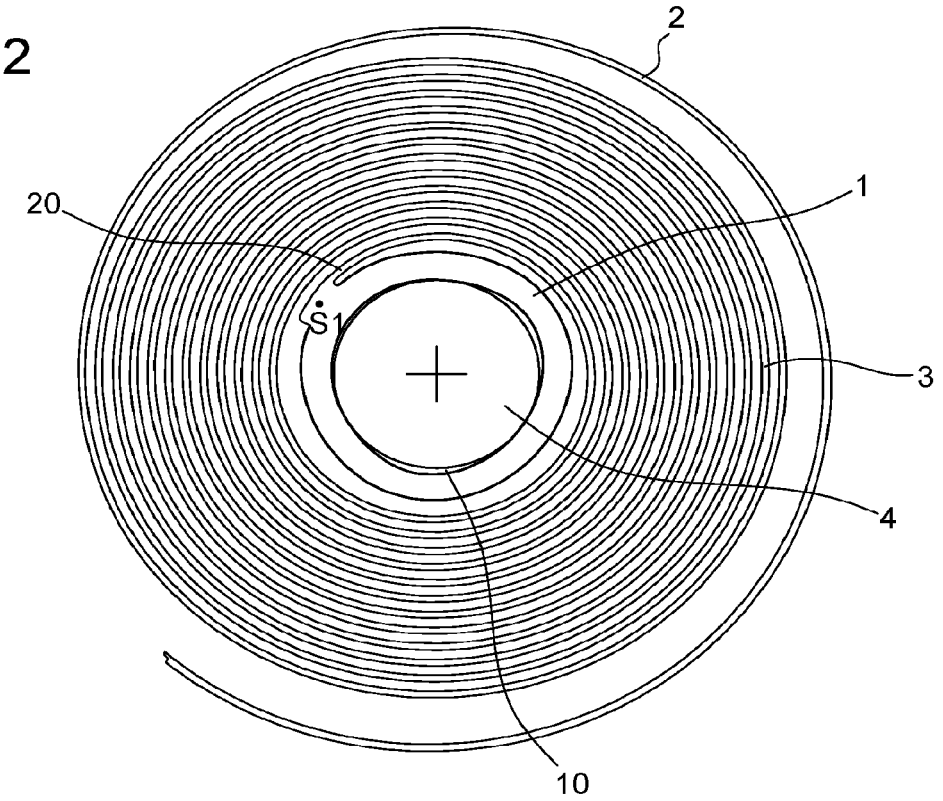
FIG. 2 is a top view diagram of a collet/balance spring assembly according to the invention.

The collet/balance spring assembly illustrated in FIG. 2 is made in a single one-piece component, typically made of silicon. It comprises a collet 1 and a balance spring 2 attached via the inner coil 20 thereof to a point of attachment S1 on the periphery of collet 1. The collet/balance spring assembly is held on a balance staff 4 of circular section by driving collet 1 onto staff 4.

Collet 1 includes a substantially cylindrical passage 10, configured to deform elastically in a plane P perpendicular to the axis of passage 10 and thus to receive and elastically clamp balance staff 4. Flexible passage 10 is ovoid in shape, and more preferably "triangular-oval", and includes at least two lines of contact with balance staff 4.

According to a preferred embodiment illustrated in the Figures, flexible passage 10 is triangular-oval in shape, and has three lines of contact 11*a*, 11*b* and 11*c* with balance staff 4, the three lines of contact forming, for example, an equilateral triangle. The three lines of contact 11*a*, 11*b*, 11*c* with balance staff 4 form angles α, β and θ between them.

Lines of contact 11*a*, 11*b* and 11*c* delimit recessed parts 10*a*, 10*b* and 10*c* between collet 1 and balance staff 4, these recessed parts 10*a*, 10*b* and 10*c* being non-contact areas.

Figure 1:
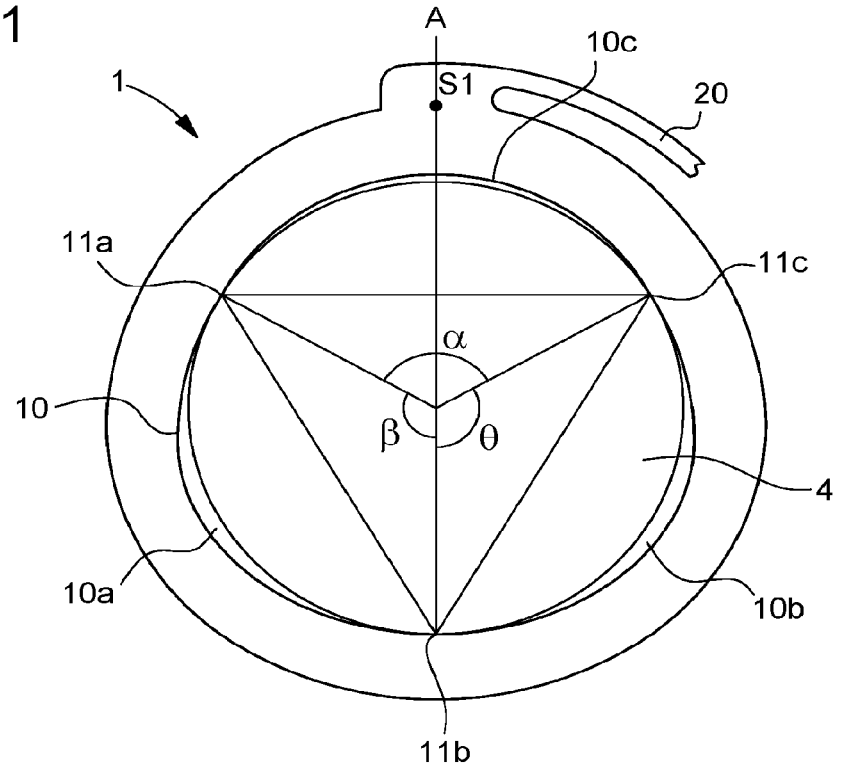
FIG. 1 is a diagram in which the collet is elastically deformed.

As can be observed in FIG. 1, one of the lines of contact is diametrically opposite the point of attachment to balance spring 2, and therefore collet 1 does not undergo deformation at the point of attachment and the position of the point of attachment of balance spring 2 is not altered when collet 1 is set in place.

According to the invention, the three lines of contact 11*a*, 11*b* and 11*c* form between them an angle which is preferably greater than 90°, more preferably less than 150°, and here is substantially equal to 120°.

Under the effect of elastic deformation, passage 10 exerts, at lines of contact 11*a*, 11*b*, 11*c*, elastic return forces returning the inner wall of the passage into contact with the balance staff.

According to the invention, the distance between balance staff 4 and collet 1 at recessed parts 10*a*, 10*b* and 10*c* is greater than 0. There is thus a clamping force at the three lines of contact 11*a*, 11*b* and 11*c* but no clamping force at recessed parts 10*a*, 10*b* and 10*c*.

Preferably, the distance between balance staff 4 and collet 1 at recessed parts 10*a*, 10*b* and 10*c* is comprised between 0 and a quarter of the diameter of balance staff 4. Even more preferably, the distance between balance staff 4 and collet 1 at recessed parts 10*a*, 10*b* and 10*c* is comprised between 0 and 50 μm.

Advantageously, the distance between balance staff 4 and collet 1 ensures a small amount of play when a clamping force is applied at contact lines 11 *a*, 11 B and 11 C.

This arrangement has the particular advantage of maximising the radius of support of passage 10 of collet 1 on staff 4, while ensuring sufficient holding torque on balance staff 4, with a lower level of stress than the maximum allowable stress of the material. Advantageously, a larger radius of support provides a higher holding torque.

Thickness is determined so that the maximum stress exerted by balance staff 4 on passage 10 is lower than the elastic limit of the material forming collet 1, so that collet 1 adapts to the manufacturing tolerances of balance staff 4 and so that the hold of collet 1 on staff 4 (rotational torque, pressing-in force) is adequate.

As illustrated in FIG. 2, balance spring 2 includes a strip 3 wound in coils around itself, the inner coil 20 being integral with collet 1.

As seen in FIG. 2, the point of attachment S1 between inner coil 20 and collet 1 is located on collet 1. It is also noted that collet 1 is symmetrical relative to the axis A passing through the centre C of collet 1 and the point of attachment S1.

According to a preferred embodiment of the invention, collet 1 and balance spring 2 are made of silicon.

According to another embodiment of the invention, collet 1 and balance spring 2 are formed of a material with no plastic deformation, such as single crystal silicon, polycrystalline silicon, porous silicon, amorphous silicon, doped single crystal silicon, doped polycrystalline silicon, doped or undoped silicon carbide, doped or undoped silicon nitride, doped or undoped silicon oxide such as quartz or silica, or ceramic.

Collet 1 and balance spring 2 may also be made of a material such as amorphous metal.

Of course, this invention is not limited to the illustrated example but is capable of various variants and alterations that will appear to those skilled in the art.

LIST OF PARTS

1 Collet
10 Passage
10*a* Recessed part
10*b* Recessed part
10*c* Recessed part
11*a* Line of contact
11*b* Line of contact
11*c* Line of contact
2 Balance spring
3 Balance spring strip
4 Balance staff
α Angle
β Angle
θ Angle
S1 Point of attachment
C Centre of the collet
Da Staff diameter

What is claimed is:

1. A timepiece collet comprising:

a point of attachment with a balance spring; and a passage to receive a balance staff and to surround an entire circumference of the balance staff, wherein the passage is substantially cylindrical and is configured to deform elastically in a plane perpendicular to an axis of the passage and to elastically clamp the balance staff by at least two lines of contact extending over a height of an inner wall of the passage when the balance staff is inserted in the passage, the passage forms recessed parts that each provide a spacing between the balance staff and the inner wall of the passage when the balance staff is inserted in the passage, and the recessed parts include three crescent shaped recessed parts, and a thickness of the timepiece collet, from an outer contour line of each of the three crescent shaped recessed parts to an outer surface of the timepiece collet, is substantially uniform around the entire circumference of the balance staff.

2. The timepiece collet according to claim 1, wherein the passage is ovoid in shape.

3. The timepiece collet according to claim 1, wherein the passage is configured to elastically clamp the balance staff by three lines of contact, which have angular openings α, β, θ, one of the three lines of contact being diametrically opposite the point of attachment with the balance spring.

4. The timepiece collet according to claim 3, wherein the angular openings α, β, θ are each less than 150°.

5. The timepiece collet according to claim 3, wherein the angular openings α, β, θ are each greater than 90°.

6. The timepiece collet according to claim 3, wherein the angular openings α, β, θ are each equal to 120°.

7. The timepiece collet according to claim 1, wherein a distance between the balance staff and the timepiece collet at the recessed parts is comprised between 0 and one quarter of a diameter of the balance staff.

8. The timepiece collet according to claim 1 comprising a variable section.

9. A one-piece collet/balance spring assembly comprising the timepiece collet according to claim 1.

10. The one-piece collet/balance spring assembly according to claim 9, wherein the timepiece collet and the balance spring are made of silicon.

11. The one-piece collet/balance spring assembly according to claim 9, wherein the timepiece collet and the balance spring are made of a material with no plastic deformation.

12. A timepiece movement or timepiece comprising the one-piece collet/balance spring assembly according to claim 9.

13. The timepiece collet according to claim 1, wherein a distance between the balance staff and the timepiece collet at the recessed parts is comprised between 0 and 50 μm.

14. The timepiece collet according to claim 1, wherein the passage is configured to elastically clamp the balance staff by only three lines of contact.

15. The timepiece collet according to claim 1, wherein the crescent shaped recessed parts provide the spacing between a circular balance staff and the inner wall of the passage when the circular balance staff is inserted in the passage.

16. The timepiece collet according to claim 1, wherein the passage forms only the three crescent shaped recessed parts.

17. The timepiece collet according to claim 1, wherein the passage is triangular-oval in shape.

18. The timepiece collet according to claim 1, wherein the timepiece collet is made of a material with no plastic deformation.

19. A timepiece collet comprising:

a point of attachment with a balance spring; and a passage to receive a balance staff and to surround an entire circumference of the balance staff, wherein the passage is strictly ovoid in shape and is configured to deform elastically in a plane perpendicular to an axis of the passage and to elastically clamp the balance staff by at least two lines of contact extending over a height of an inner wall of the passage when the balance staff is inserted in the passage, the passage forms recessed parts that each provide a spacing between the balance staff and the inner wall of the passage when the balance staff is inserted in the passage, and an outer surface of the timepiece collet that contours the passage is strictly ovoid in shape.

20. A timepiece collet comprising:

a point of attachment with a balance spring; and a passage to receive a balance staff and to surround an entire circumference of the balance staff, wherein the passage is substantially cylindrical and is configured to deform elastically in a plane perpendicular to an axis of the passage and to elastically clamp the balance staff by at least two lines of contact extending over a height of an inner wall of the passage when the balance staff is inserted in the passage, the passage forms recessed parts that each provide a spacing between the balance staff and the inner wall of the passage when the balance staff is inserted in the passage, and the recessed parts include three crescent shaped recessed parts, and a maximum of the spacing in a first one of the crescent shaped recessed parts is less than a maximum of the spacing in at least a second one of the crescent shaped recessed parts, the maximum of the spacing in the first one of the recessed parts is diametrically opposite the point of attachment with the balance spring.

* * * * *